8/13/85 XR 4,535,225

United States Patent [19]

Wolf et al.

[11] Patent Number: 4,535,225

[45] Date of Patent: Aug. 13, 1985

[54] HIGH POWER ARC HEATER

[75] Inventors: Charles B. Wolf, Irwin; Thomas N. Meyer, Murrysville; Maurice G. Fey, Plum Boro; John E. Heidrich, Livermore, all of Pa.

[73] Assignee: Westinghouse Electric Corp., Pittsburgh, Pa.

[21] Appl. No.: 588,595

[22] Filed: Mar. 12, 1984

[51] Int. Cl.[3] ..... H05B 7/18

[52] U.S. Cl. ..... 219/383; 219/121 PR; 219/123; 313/231.41; 315/111.21

[58] Field of Search ..... 219/383, 384, 121 P, 219/121 PM, 121 PR, 123, 122; 315/111.21; 237/50; 266/200; 313/231.41, 231.51, 231.61, 249, 250, 251

[56] References Cited

U.S. PATENT DOCUMENTS

| | | | |
|---|---|---|---|
| 3,590,219 | 6/1971 | Painter | 219/383 |
| 3,705,975 | 12/1972 | Wolf et al. | 219/383 |
| 3,953,705 | 4/1976 | Painter | 219/121 P |
| 4,042,802 | 8/1977 | Fey et al. | 219/121 P |
| 4,214,736 | 7/1980 | Wolf et al. | 266/200 |

FOREIGN PATENT DOCUMENTS

| | | | |
|---|---|---|---|
| 1360659 | 7/1974 | United Kingdom | 315/111.21 |
| 2116810 | 9/1983 | United Kingdom | 315/111.21 |
| 432867 | 8/1975 | U.S.S.R. | 219/383 |
| 500605 | 6/1976 | U.S.S.R. | 219/383 |

*Primary Examiner*—Roy N. Envall, Jr.
*Assistant Examiner*—M. M. Lateef
*Attorney, Agent, or Firm*—John Victor Pezdek

[57] ABSTRACT

A high power non-transferred electric arc heater utilizing interelectrode segments which create a stepped arc chamber intermediate two hollow, substantially cylindrical, axially spaced electrodes. Gas to be heated is admitted upstream of the arc chamber and between adjacent segments. Gas is used to form a cold boundary layer about the expanding core of arc-heater gas. Additional secondary gas inlets adjacent the electrode provide fluid dynamic means for arc positioning on the electrode segments. Gas pressures of less than or in the range of about 1 atmosphere to about 50 atmospheres are used with power levels of about 10 MW being possible. The stepped arc chamber facilitates arc transfer to the downstream electrodes and allows a larger diameter for the arc heated gas while the boundary layer of gas maintaining comparable spacing along the length of the arc-heated gas and the surface of the arc chamber reducing the rate of heat transfer from the arc heated gas to the segments of the arc heater. In an alternate embodiment, field coils are provided around the interelectrode segments and electrodes for the magnetic rotation of the arc within the arc chamber. In a further embodiment, a resistor is interconnected between each interelectrode segment and the electrode segment that is connected as the cathode. These resistors assist in arc initiation and reduce the possibility of strikeover to the interelectrode segments during operation. Multiple electrode segments connected as anode or cathodes can also be provided.

40 Claims, 3 Drawing Figures

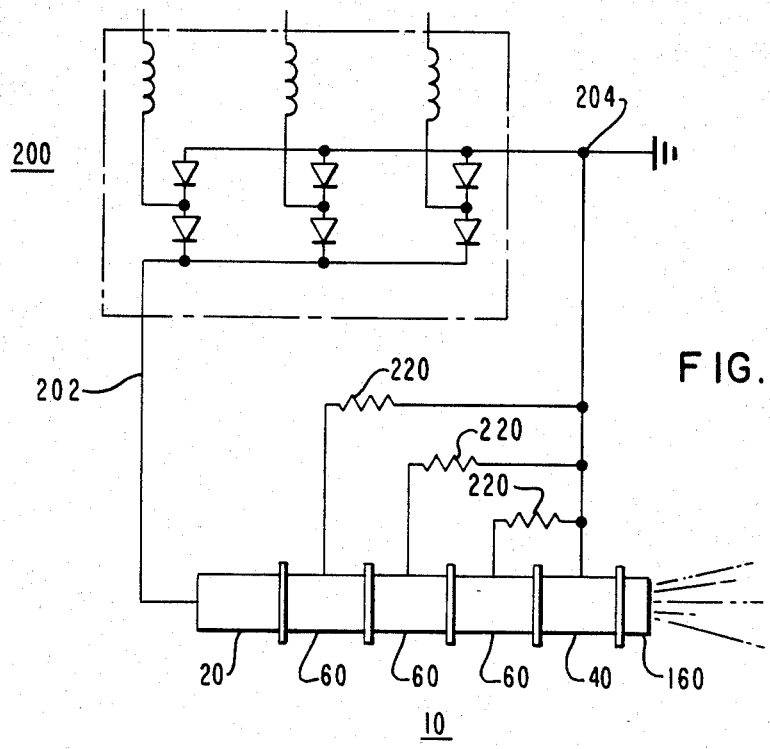
FIG. 2
FIG. 3
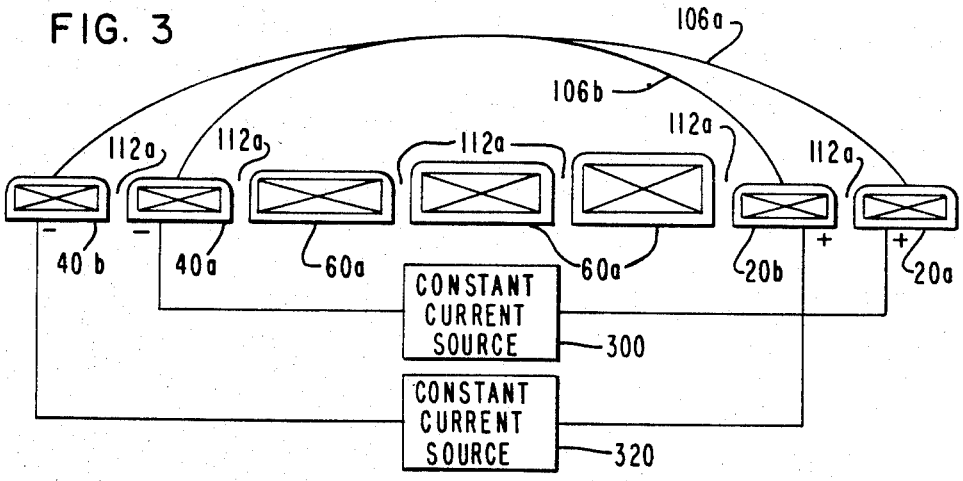

HIGH POWER ARC HEATER

BACKGROUND OF THE INVENTION

This invention relates in general to electric arc heaters and in particular to non-transferred electric arc heaters capable of high power operation for extended periods of time.

Electric arc heaters designed for industrial applications are used to heat a wide range of gas compositions to high temperatures. The high temperature gases can be used for heating a furnace or for chemical or metallurgical processes. Typically, these arc heaters are designed for flange mounting to an opening on the furnace or chemical reactor with the arc-heated gas discharge end terminating at the flange attachment or protruding through the wall of the furnace or reactor. Examples of this type of arc heater may be found in U.S. Pat. No. 3,705,975, entitled "Self-Stabilizing Arc Heater Apparatus", issued Dec. 12, 1972 and U.S. Pat. No. 4,214,736, entitled "Arc Heater Melting System" issued July 29, 1980, both patents assigned to the assignee of the present invention. The arc heaters described in these patents include features such as water-cooled axially spaced electrodes having small electrode gaps for simple arc starting and stabilization and water-cooled field coils for rotating the arc over the surfaces of electrode to reduce water and erosion caused by the arc. Power levels of up to 3 megawatts have been obtained in commercial applications of this type of arc heater. However, for many industrial applications where conversion to electrical heating is economically viable, the total heating requirement may be in the range of 10 to 40 megawatts or higher. An electric arc heater capable of higher power operation would minimize the total number of units and associated equipment required for these higher power applications; thus, simplifying the overall installation.

By simultaneously increasing the gas flow rate and lengthening the downstream electrode, it is believed that power levels of these existing designs of arc heaters could be increased to reach these higher power levels. However, with this approach, the downstream electrode would be heavier, more cumbersome to replace and more expensive to manufacture. Further, the length of the downstream electrode required for these higher power levels would be longer than the average arc length due to the tendency of the arc to continuously restrike at various positions along the length of the downstream electrode. This variation in arc length, which can be significant where the length of the electrode is a significant proportion of the maximum arc length achievable in the arc heater, causes power fluctuations that decrease operating efficiency. In addition, because of the large heat transfer surface presented by the downstream electrode, the efficiency of the electric arc heater is further reduced. Therefore, it would be advantageous to have an electric arc heater which can operate at these high power levels at a reasonable level of efficiency (typically 80% or greater). The design should also inhibit restriking of the arc to maximize arc length and power within the arc heater.

One solution to maximize arc length and inhibit arc restrike on the electrode has been to incorporate one or more interelectrode segments between the two electrodes of the arc heaters. Examples of this construction can be found in U.S. Pat. No. 3,953,705, entitled "Controlled Arc Gas Heater" issued Apr. 27, 1976 and in British Patent Specification No. 1,360,659, published July 17, 1974, entitled "Heating Device". Both designs utilize one or more interelectrode segments between the two electrodes in order to increase arc length. The segments are electrically insulated from the electrodes in order to minimize the occurrence of arc restrike.

For maximum heat transfer from the arc to the gas, and therefore for maximum arc voltage, the passageway formed by the interelectrode segments is reduced in diameter. This constricts gas flow, increases turbulence; thus, maximizing heat transfer. With these designs, because the diameter of the constriction is substantially less than the diameters of the electrodes, the pressure of the gas therein is kept at a high value. This in turn demands a greater potential difference between the two electrodes of the arc heater in order to maintain the arc, because the voltage gradient in the arc heater is proportional to the square root of pressure, the total power input to the gas is increased by maintaining a high arc pressure. The increased power input increases the net energy transferred to the gas that is being heated. Although high power operation is achieved, high gas pressures, typically on the order of 1500 psig, are required. These high pressures necessitate more elaborate gas supply systems including costly high pressure compressors. Thus, it would be advantageous to have a high power arc heater capable of operating at lower gas pressures. Further, because of the high power level of these devices, electrode life is relatively short and is measured in terms of a few hours. This short electrode life is unacceptable for industrial applications. Therefore, it would be advantageous to have a high power arc heater having electrode life measured in terms of hundreds of hours instead of just hours. Because the passageway through the interelectrode segments is substantially smaller than the diameters of the electrodes that are used, initiation of the arc can be difficult. A high power arc heater in which are initiation is facilitated by the design of the interelectrode segments would also be advantageous.

One object of the present invention is to provide a high power electric arc heater having electrode life which is acceptable in an industrial environment. Another object of the invention is to provide an arc heater in which arc initiation is facilitated, and one in which arc strikeover to the interelectrode segments is minimized. A further object of the invention is to provide a high power arc heater capable of operating on gas pressures substantially less than 1500 psig.

SUMMARY OF THE INVENTION

The present invention is embodied in an electric arc heater having an upstream and downstream electrode separated by a plurality of electrically insulated interelectrode segments. The interelectrode segments are axially spaced apart and form an arcing chamber therein. The interelectrode segment adjacent the upstream electrode has an internal diameter that is less than the internal diameter of the upstream electrode while the interelectrode segment adjacent the downstream electrode has an internal diameter less than or equal to the internal diameter of the downstream electrode. The internal diameters of the interelectrode segments increase in a stepwise manner in the downstream direction to form a stepped arc chamber. The stepped arc chamber encourages gas flow in the downstream axial direction facilitating arc transfer to the downstream electrode during start-up. Further, it allows for a larger diameter for the core of hot gas while maintaining comparable spacing between the core of hot gas and the colder walls thus reducing the heat transfer rate to the walls. Gas inlets are provided for admitting a gas into the arc chamber to form a boundary layer of gas about the surface. Additional gas inlets are provided upstream and downstream of the upstream and downstream electrode segments respectively. These additional gas inlets are used as fluid dynamic means to axially position the arc on the surfaces of the electrodes. At the downstream electrode gas inlet countercurrent gas flow is used for this positioning. Gases of various composition can be used throughout or at selected points of admission to produce the desired process gas at the outlet or to enhance electrode life. In addition, field coils can be provided about the upstream electrode segment, the downstream electrode segment and the interelectrode segments to provide a magnetic field utilized for rotating the arc within the arc chamber.

In an alternate embodiment, resistors are connected between each of the interelectrode segments and the electrode segment connected as the cathode for establishing the electrical potential of each interelectrode segment as being approximately equal to the value of the electrical potential gradient established by the arc within the arc chamber. Because the magnitude in the voltage of the arc and that appearing at each adjacent portion of interelectrode segment along the length of the arc heater is approximately equal resulting in only a small potential difference, strikeover of the arc to the interelectrode segments is reduced.

In a further embodiment of the invention, dual downstream electrodes, dual upstream electrodes, or both are provided with the arc current beiing shared between the dual electrodes contributing toward greater electrode life. When dual electrodes are provided for both the upstream and downstream electrodes segments of the arc heater, dual constant current sources can be provided for the electrode pairs, each pair consisting of one upstream electrode segment and one downstream electrode segment.

BRIEF DESCRIPTION OF THE DRAWINGS

For a better understanding of the invention, reference may be made to the embodiments exemplary of the invention shown in the accompanying drawings wherein:

FIG. 2 is a simplified schematic representation of the electrical interconnections required for the arc heater of FIG. 1; and FIG. 3 is an axial partial sectional illustration of an arc heater employing dual upstream and downstream electrodes.

DETAILED DESCRIPTION

Figure 1:
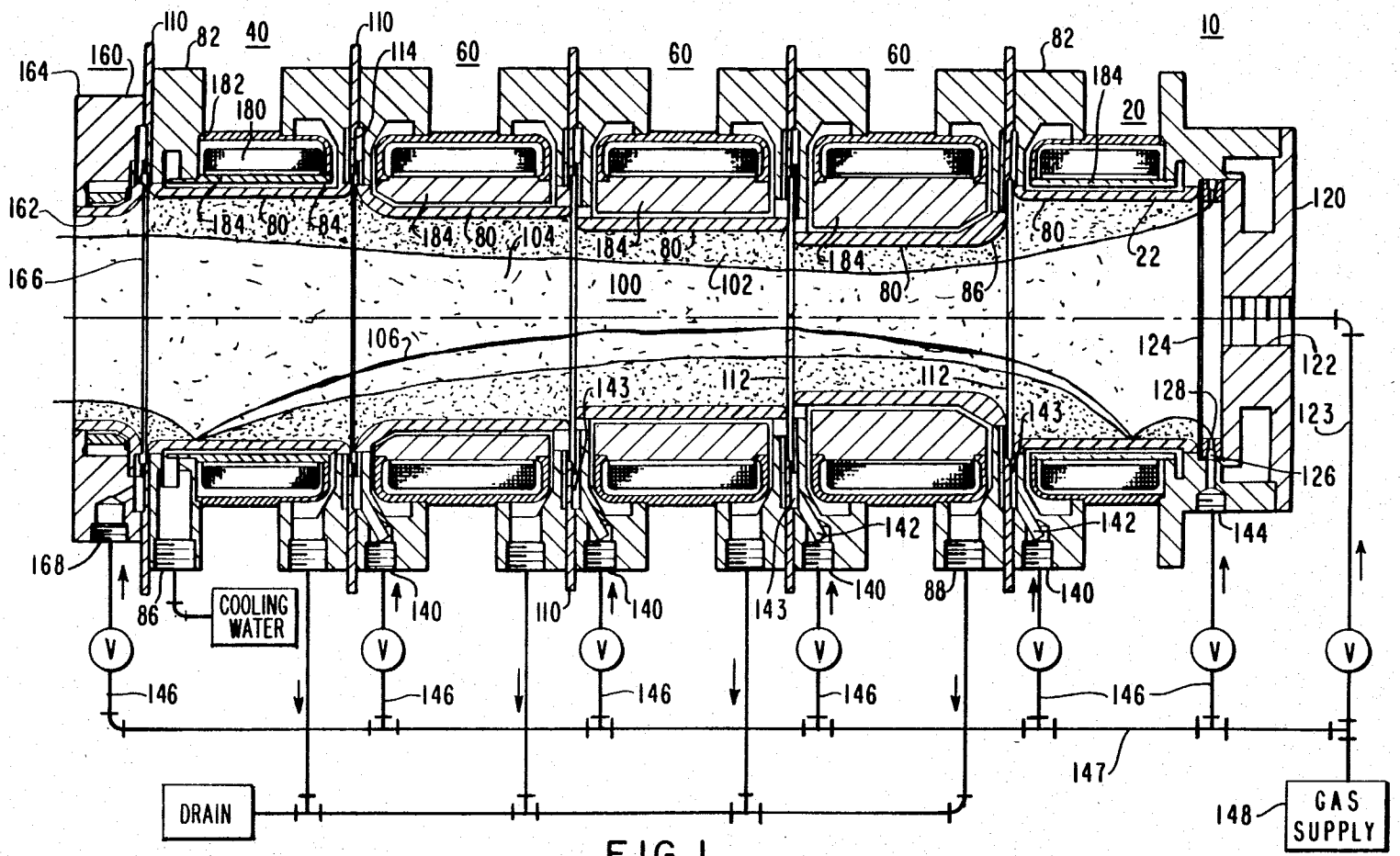
FIG. 1 is an axial sectional view of a gas electric arc heater constructed in accordance with and embodying the present invention.

Referring to FIG. 1, the arc heater 10 includes an upstream electrode segment generally indicated at 20, a downstream electrode segment generally indicated at 40 and a plurality of intermediate electrode segments generally indicated at 60 that are axially aligned with and positioned intermediate the upstream electrode segment 20 and downstream electrode segment 40. The segments of the arc heater are secured together by means of electrically insulated fastening bolts (not shown). The electrode segments and the intermediate electrode segments are substantially cylindrical and hollow with the upstream electrode segment 20 and the downstream electrode segment 40 having approximately the same internal diameter. Each segment of the arc heater has an internal sleeve 80, preferably fabricated from copper or copper alloys, that provides the internal surface for the arc chamber 100. The sleeves 80 slide into the outer housings 82 of each segment such that passageways 84 are formed between each inner sleeve 80 and each outer housing 82 so that a fluid such as water may be circulated therein for cooling purposes. A cooling water inlet 86 and a cooling water outlet 88 are provided in each segment in order to permit circulation of the cooling water. This circulation through the segments can be accomplished with the segments connected in parallel as shown in FIG. 1, in series, or in various combinations of series-parallel arrangements.

An annular insulating plate 110 is provided between adjacent segments of the arc heater in order to electrically isolate each segment from its neighbor. In addition, the insulating plates 110 maintain the axial gaps 112 between the various segments in the arc heater 10. An end cap 120 is provided for closing off the upstream end 22 of the upstream electrode segment 20. This end cap 120 also has a core gas inlet 122 substantially along the axial center line of the arc heater for admission of a core gas stream 123 into the arc chamber 100. Each segment 20, 40, and 60 is also provided with a boundary gas inlet 140 that communicates to the arc chamber 100 via a passageway 142, an annular header 143 and the axial gap 112 for the admission of one or more boundary gas streams 146. The header 143 is formed between the insulating plate 110 and electrode or interelectrode segments on which it is mounted by providing an annular channel in the surface of the insulating plate, the segment, or both. The insulating plates 110 can be provided with a pluarlity of channels (not shown) between the annular headers 143 and the arc chamber 100. The axial and radial orientation of these channels can be used to create various swirl patterns of the incoming boundary gases. For example tangentially positioned planar channels would cause the incoming boundary gases to tangentially swirl about the surface of the sleeves 80 that define the arc chamber 100. The number of these channels in each insulating plate can be increased or decreased to increase or decrease the gas flow from the passageways 142.

The boundary gas inlets 140 are used for one or more boundary gas streams 146. The boundary gas streams entering the arc chamber 100 through the gaps 112 form a boundary layer 102 of gas that is cold in comparison to the temperature of the arc-heated gas core 104, i.e. essentially ambient versus 1000° C. to 10,000° C. Because the heat transfer characteristics of this incoming boundary gas is poor in comparison to that of the metal sleeves 80, the boundary layer acts like a heat insulating blanket and thus protects the surfaces of the sleeves 80. This contributes to longer operating life for the electrode and interelectrode segments.

The passage of the boundary gases through the gaps 112 also helps to maintain the electrical insulating properties of the insulating plates 110 and the gaps 112. Mixing of the gases in the boundary layer 102 and in the arc heated core 104 will occur at the interface between the two layers. For some processes this can be beneficial as it can assist in the formation of desired reaction products.

The valves v in the gas supply manifold 147 can be provided for flow control of the various gas streams into the arc heater. Normally gas would be supplied to all of the inlets; however, less than all of the inlets can be used during operation of the arc heater. The number of inlets required and which inlets to use would be determined by the demands of the process in which the arc heater is used. Normally the core gas stream 123 is used but it can be eliminated. In this case the arc heated gas core is formed by the arc heating the boundary gas.

In FIG. 1 a single gas supply 148 is shown for both the core gas stream and the boundary gas streams; however, more than one gas supply and more than one type of gas can be used. For example argon could be supplied to the interelectrode segments 60 with nitrogen being supplied as the core gas 123. Various mixtures of gases could also be supplied to the arc heater. Gases that can be used in the arc heater include hydrogen, carbon monoxide, carbon dioxide, water vapor, air, nitrogen, oxygen, argon and various combinations of these gases. Inlet gas pressures can be within the range of about 1 to about 50 atmospheres. The exact inlet pressure range is determined by the process; however, the rule of thumb is to have the inlet pressure be approximately twice the desired exit pressure of the arc heater. Inlet pressures in the range of about 4 to about 6 atmospheres have been used.

Boundary gas entry at the upstream end 22 of the upstream electrode 20 is accomplished by providing the end cap 120 with annular ring 124, preferably detachable, having an annular channel 126 therein that connects with the gas inlet 144 located at upstream end 22. The annular channel 126 communicates with the arc chamber 100 via a series of passageways 128. By changing the radial or axial positions of the passageways 128 with respect to radius of the arc chamber 100 tangential, radial, or axial boundary gas entry concurrent or countercurrent to the other gas flows can be accomplished. This also permits axial positioning of the arc on the surface of the inner sleeve 80 of the upstream electrode segment 20. Although not shown in FIG. 1, an axial gap similar to the axial gaps 112 can be provided between the end cap 120 and the upstream end 22 of the upstream electrode 20 by using a plate similar in shape to the insulating plate 110. Typically, during operation of the arc heater 10 the end cap 120 is at the same electrical potential as the upstream electrode 20. However, the use of a plate having electrical insulating value would allow the end cap to be electrically isolated from the upstream electrode 20 if desired.

In axial cross section, the interior of the arc heater 10 appears to be stepped. The internal diameter of the interelectrode segment adjacent to the upstream electrode 20 is less than that of the diameter of the upstream electrode. The internal diameters of the interelectrode segments which follow downstream increase in a stepwise manner with the interelectrode segment adjacent the downstream electrode having an internal diameter that is equal to or less than that of the downstream electrode. Preferably, the inside diameter of each of the interelectrode segments 60 are chosen such that the total gas flow per unit area ratio is made approximately constant. The upstream end 86 of the sleeve for the interelectrode segment adjacent the upstream electrode is rounded to present a more streamlined opening for the gases to pass through. The number of interelectrode segments 40 is dependent on the particular gas which is used, the power level, the distribution of the gas into the axial gaps, and the enthalpy and flow rates required for the particular application.

The stepped arc chamber 100 that is formed by the stepped interelectrode segments 60 encourages the entering boundary gas to go in the downstream axial direction facilitating arc transfer to the downstream electrode 40 during startup and the formation of the boundary layer 102. Further, this design permits a larger diameter for the arc-heated gas core 104 that is produced while maintaining about the same thickness for the boundary layer 102 between the arc-heated gas core 104 and the surface of the inner sleeves 80. Thus, even though the volume of hot gas is increasing, the rate of heat transfer to the walls remains approximately the same throughout the length of the arc heater. This helps to increase the operating efficiency of the arc heater.

A water-cooled nozzle 160 including an inner sleeve 162 and an outer housing 164 can be provided downstream of the downstream electrode segment 40. The insulating plate 110 is used to provide an axial gap 166 that connects with the gas inlet 168 in the outer housing 164. The insulating plate 110 can be modified as previously described. Preferably, the boundary gas entering through the axial gap 166 flows in a countercurrent direction with respect to the arc-heated gas core 104. Use of the countercurrent gas flow permits axial positioning of the arc 104 on the surface of the inner sleeve 80 of the downstream electrode segment 40.

The use of gas positioning of the arc also permits the use of a wide range of nozzle styles including straight, divergent or convergent-divergent. With previous designs the nozzle style was selected to provide sufficient backpressure to prevent the transfer of the arc from the downstream electrode into the nozzle or beyond. One goal in using an arc heater is to have large gas flow rates in order to improve operating efficiency. As the gas flow increases, its tendency for arc carryover into the nozzle increases requiring higher backpressures in the region of the downstream electrode. With the present invention the necessity of using the nozzle to prevent arc carryover is substantially eliminated. The larger diameter downstream electrode allows the gas flow velocity to decrease and permit the arc to attach there rather than be blown further downstream. In addition to these fluid-dynamic means for arc positioning within the arc heater, annular field coils 180 can be mounted about each segment. In each electrode and interelectrode segment, a chamber 182 formed by the outer housing 82 and the inner sleeve 80 is provided for this purpose. Suitable openings (not shown) in the outer sleeves 82 which communicate with the chambers 182 allow the electrical connections to the field coils 180 to be made. When energized, these field coils produce a magnetic field which interacts with the current flowing in the arc 106 causing the rotation of the arc 106 about the surface of the two electrode segments 20 and 40, and the interelectrode segments 60; thus, reducing erosion rate at any possible arc attachment point.

Annular spacing rings 184 are positioned between the field coils 180 and the inner sleeves 80 forming the cooling passageways 84 along their inner diameters while forming a portion of the chambers 182 along their outer diameters. The width of the spacing rings 184 varies inversely with the expanding diameter of the arc chamber 180 and is at its smallest dimension at the electrode segments 20 and 40.

In FIG. 2, the elementary operating schematic for the arc heater of FIG. 1 is illustrated. When referring to the drawings, elements having similar characteristics are given the same numeric designation. There, a power supply, preferably DC and generally indicated as 200, is electrically connected to the upstream electrode segment 20 and the downstream electrode segment 40. The power supply used should be capable of providing a voltage of sufficient magnitude to initiate arcing and of providing sufficient current once the arc is established. Because of the current control available, a multiphase AC rectified thyristor-controlled DC power supply is preferred. Conventional arc initiation means can be used in order to lower the magnitude of the voltage which is required for initiation of arcing. Either electrode segment can be the anode or cathode. Typically, the upstream electrode segment 20 is electrically connected to the positive terminal 202 of the power supply 200 and functions as the anode with the downstream electrode segment 40 being electrically connected to the return 204 or ground side of the power supply and serving as the cathode. Resistors 220 are electrically interconnected between each interelectrode segment 60 and the electrode segment which is connected as the cathode. When used, these resistors aid in arc initiation and serve to limit leakage current during arcing.

At startup of the arc heater the resistors 220 act to distribute the applied voltage across the segments of the arc heater creating a voltage gradient across the arc heater prior to the establishment of the arc. This facilitates arc initiation. When the arc is established between the two electrode segments 20 and 40, a voltage gradient exists within the arc heater 10. The resistors 220 now act to limit the leakage current from each interelectrode segment. Preferably, these resistors are sized to limit this leakage current to less than one ampere. The actual value of each resistor is determined by the magnitude of the arc voltage gradient at the interelectrode segment to which the resistor is connected and the desired value for the leakage current. The values for the resistors decrease as the electrode that is connected to the return of the power supply is approached with the lowest valued resistor being connected to the interelectrode segment adjacent this electrode segment. Typically this is the downstream electrode segment 40. During operation because the potential difference between the arc and the interelectrode segment is small in comparison for the arc breakdown voltage required for the arc to strikeover to the interelectrode segment, arc strikeover to the interelectrode segments 60 is reduced.

Prior to or concurrent with arc initiation, gas flow, usually argon, is started via the boundary gas inlets the core gas inlet, or both. A voltage of a magnitude sufficient to ensure arc breakdown is then impressed across the two electrode segments 20 and 40. Because of the resistors 220 and for the connections as described, essentially full voltage appears across the first axial gap between the downstream end of the upstream electrode 20 and the interelectrode segment 60 adjacent thereto. In quick succession, a series of multiple low current arcs are then formed across the remaining axial gaps. Once these low current arcs (1 to 2 amps) are started across the axial gaps, the total current increases into the range of hundreds of amps. At this point, the gas flow through the arc heater will cause the arcs to lengthen and be blown downstream where they combine with one another to form a single arc extending from the upstream electrode segment 20 to the downstream electrode segment 40. Thus, the resistors 220 connected to the interelectrode segments 60 provide three functions: one during starting to assist in arc break-down, and the others during operation to limit strikeover of the arc to the segments and leakage current, the latter conditions greatly affecting the efficiency of the arc heater. Operating data from four test runs for the arc heater illustrated in FIGS. 1 and 2 is provided in Table 1.

TABLE 1

| | Operating Characteristics | | | |
|---|---|---|---|---|
| | Test 1 | Test 2 | Test 3 | Test 4 |
| Core and Boundary Gas Flow ($Nm^3/hr$) | 997 | 1018 | 1018 | 733 |
| Arc Voltage (v) | 1800 | 2240 | 2518 | 1979 |
| Arc Current (a) | 1170 | 1075 | 982 | 1057 |
| Arc Heater Power (kw) | 2106 | 2408 | 2473 | 2092 |
| Gas Inlet Pressue (Atm) | 6 | 6 | 6 | 4.08 |
| Estimated Gas Outlet Temp. (°K.) | 3400 | 3550 | 3550 | 4900 |

An alternate embodiment of the present invention is illustrated in the partial sectional view of FIG. 3. There, dual upstream and downstream electrode segments and dual power supplies are illustrated. The structures of the electrode and interelectrode segments is substantially the same as those previously described. Constant current source 300 is connected between upstream electrode segment **20*a* and downstream electrode segment 40*a* with constant current source 320 being connected between upstream electrode segment 20*b* and downstream electrode segment 40*b*. The electrical connections between the electrode segments and the constant current sources 300 and 320 are substantially the same as those described for the power supply and arc heater of FIG. 2. However, when one electrode segment is connected as the anode, the adjacent electrode segment is also connected to its respective power supply as the anode. Although dual power supplies are shown, a single power supply appropriately modified to provide the necessary currents and voltages to the dual set of electrode segments can also be used. With dual upstream and downstream electrode segments, two arcs 104*a* and 104*b* are produced and merged with one another as they pass through the interelectrode segments 60*a***. This arrangement allows for lower current flow through the individual upstream and downstream electrode segments helping to extend their operating life.

Another operating arrangement (not shown) for the electrode segments is the use of a single upstream electrode connected as the anode with dual downstream electrodes connected as cathodes. We have found that major wear often occurs on the electrode segment that functions as the cathode and this wear or erosion is a strong function of arc current. With two cathodes, each carries one-half the arc current, thus helping to decrease electrode wear. A single power supply appropriately modified or dual power supplies can be used with this arrangment. When multiple electrodes are present, they are electrically isolated from one another in a fashion similar to that used with the interelectrode segments 60. Axial gaps are also provided to permit the entry of boundary gas into the arc heater.

Other embodiments of the invention will be apparent to those skilled in the art from a consideration of this specification or practice of the invention disclosed herein. It is intended that the specification be considered as exemplary only with the true scope and spirit of the invention being indicated by the following claims.

We claim:

1. An electric arc heater, comprising:

an upstream electrode segment;

a downstream electrode segment, the upstream and downstream electrode segments being substantially cylindrical, spaced apart, hollow, and axially aligned;

a plurality of electrically insulated interelectrode segments positioned intermediate the upstream electrode segment and the downstream electrode segment, the interelectrode segments being substantially cylindrical, hollow, axially spaced apart from each other and the electrode segments forming a series of axial gaps therebetween, and forming an arcing chamber therein, the interelectrode segment adjacent the upstream electrode segment having an internal diameter less than the internal diameter thereof and the interelectrode segment adjacent the downstream electrode segment having an internal diameter less than or equal to the internal diameter thereof with the internal diameters of the interelectrode segments increasing in a stepwise manner in the downstream direction;

gas inlet means for admitting a gas into the arc chamber so as to form a boundary layer of gas about the surface thereof; and DC power supply means adapted to be connected to the upstream electrode segment and the downstream electrode segment for forming an arc therebetween and extending through the interelectrode segments with one electrode segment connected as the anode and the other electrode segment connected as the cathode, the arc heating a portion of the admitted gas to form a core of arc-heated gas, the arc-heated gas and boundary layer of gas exiting the arc heater at the downstream end of the downstream electrode segment with the boundary layer of gas decreasing convective heat loss of the core region of hot gas to the segments while maintaining the electrical insulation between segments.

2. The apparatus of claim 1 further comprising: upstream gas inlet means positioned upstream of the upstream electrode segment; and downstream gas inlet means positioned downstream of the downstream electrode segment, the upstream and downstream gas inlet means admitting the gas into the upstream and downstream electrode segments, respectively, for axially positioning the arc on the surfaces thereof.

3. The apparatus of claim 2 further comprising plurality of resistor means, a resistor means electrically interconnected between each interelectrode segment and the electrode segment connected as the cathode for providing sufficient voltage across the axial gaps to successively initiate arcing in the axial gaps and on establishment of the arc between the electrode segments limiting flow of leakage current from the arc through the each interelectrode segment to a value less than 1 ampere thereby reducing strikeover of the arc to the interelectrode segments.

4. The apparatus of claim 3 further comprising the upstream electrode segment being electrically connected as the anode with the downstream electrode segment being electrically connected as the cathode.

5. The apparatus of claim 4 wherein a second downstream electrode segment is provided adjacent to the downstream electrode segment and is electrically connected to the DC power supply means as a second cathode allowing the current in the arc to be shared between the two downstream electrode segments.

6. The apparatus of claim 5 wherein a second upstream electrode segment is provided adjacent to the upstream electrode segment and is electrically connected to the DC power supply means as a second anode allowing the current in the arc to be shared between the two anodes.

7. The apparatus of claim 1 further comprising:

plurality of coil means for creating a magnetic field about the arc chamber for rotating the arc therein, the coil means positioned about each electrode segment and interelectrode segment; and coil power supply means for electrically energizing the coil means.

8. The apparatus of claim 1 wherein the gas has an inlet pressure in the range of about 1 atmosphere to about 50 atmospheres.

9. The apparatus of claim 8 wherein the gas has an inlet pressure in the range of about 4 atmospheres to about 6 atmospheres.

10. The apparatus of claim 8 wherein the gas is selected from a group consisting of hydrogen, carbon monoxide, carbon dioxide, water vapor, air, nitrogen, oxygen, argon, and combinations thereof.

11. The apparatus of claim 1 wherein the inlet temperature of the gas is about ambient temperature and the temperature of the core of hot gas is in the range of about 1000° C. to about 10,000° C.

12. The apparatus of claim 1 wherein the inside diameters of each of the interelectrode segments are dimensioned such that the ratio of total gas flow to unit area is approximately constant.

13. An electric arc heater, comprising:

an upstream electrode segment;

a downstream electrode segment, the upstream and downstream electrode segments being substantially cylindrical, spaced apart, hollow, and axially aligned;

a plurality of electrically insulated interelectrode segments positioned intermediate the upstream electrode segment and the downstream electrode segment, the interelectrode segments being substantially cylindrical, hollow, axially spaced apart from each other and the electrode segments forming a series of axial gaps therebetween, and forming an arcing chamber therein, the interelectrode segment adjacent the upstream electrode segment having an internal diameter less than the internal diameter thereof and the interelectrode segment adjacent the downstream electrode segment having an internal diameter less than or equal to the internal diameter thereof with the internal diameters of the interelectrode segments increasing in a step-wise manner in the downstream direction;

gas inlet means for admitting a boundary gas into the arc chamber via the axial gaps so as to form a boundary layer of gas about the surface thereof;

DC power supply means adapted to be connected to the upstream electrode segment and the downstream electrode segment for forming an arc therebetween and extending through the interelectrode segments, the arc heating a portion of the admitted gas to form a core region of hot gas;

upstream gas inlet means positioned upstream of the upstream electrode segment;

downstream gas inlet means positioned downstream of the downstream electrode segment, the upstream and downstream gas inlet means admitting the gas into the upstream and downstream electrode segments, respectively, for axially positioning the arc on the surfaces thereof;

plurality of resistor means, a resistor means electrically interconnected between each interelectrode segment and the electrode segment connected as the cathode for providing sufficient voltage across the axial gaps to successively initiate arcing in the axial gaps and on establishment of the arc between the electrode segments limiting flow of leakage current from the arc through the each interelectrode segment to a value less than 1 ampere thereby reducing strikeover of the arc to the interelectrode segments, the shape of the arc chamber facilitating transfer of the arc to the downstream electrode allowing for a larger diameter core of arc-heated gas while increasing the power input per unit length of the electric arc heater with the boundary layer of the gas decreasing convective heat loss of the core region of hot gas to the segments while maintaining the electrical insulation between segments.

14. The apparatus of claim 13 further comprising the upstream electrode segment being electrically connected as the anode with the downstream electrode segment being electrically connected as the cathode.

15. The apparatus of claim 14 wherein a second downstream electrode segment is provided adjacent to the downstream electrode segment and is electrically connected to the DC power supply means as a second cathode allowing the current in the arc to be shared between the two cathodes.

16. The apparatus of claim 15 wherein a second upstream electrode segment is provided adjacent to the upstream electrode segment and is electrically connected to the DC power supply means as a second anode allowing the current in the arc to be shared between the two anodes.

17. The apparatus of claim 13 further comprising:

plurality of coil means for creating a magnetic field about the arc chamber for rotating the arc therein, the coil means positioned about each electrode segment and interelectrode segment; and coil power supply means for electrically energizing the coil means.

18. The apparatus of claim 13 wherein the gas has an inlet pressure in the range of about 1 atmosphere to about 50 atmospheres.

19. The apparatus of claim 18 wherein the gas has an inlet pressure in the range of about 4 atmospheres to about 6 atmospheres.

20. The apparatus of claim 18 wherein the gas is selected from a group consisting of hydrogen, carbon monoxide, carbon dioxide, water vapor, air, nitrogen, oxygen, argon, and combinations therof.

21. The apparatus of claim 13 wherein the inlet temperature of the gas is about ambient temperature and the temperature of the core of hot gas is in the range of about 1000° C. to about 10,000° C.

22. The apparatus of claim 13 wherein the inside diameters of each of the interelectrode segments are dimensioned such that the ratio of total gas flow to unit area is approximately constant.

23. An electric arc heater, comprising:

a pair of upstream electrode segments;

a pair of downstream electrode segments, the upstream and downstream electrode segments being substantially cylindrical, spaced apart, hollow, and axially aligned;

a plurality of electrically insulated interelectrode segments positioned intermediate the upstream electrode segments and the downstream electrode segments, the interelectrode segments being substantially cylindrical, hollow, axially spaced apart from each other and the electrode segments forming a series of axial gaps therebetween, and forming an arcing chamber therein, the interelectrode segment adjacent the upstream electrode segment having an internal diameter less than the internal diameter thereof and the interelectrode segment adjacent the downstream electrode segments having an internal diameter less than or equal to the internal diameter thereof with the internal diameters of the interelectrode segments increasing in a step-wise manner in the downstream direction;

gas inlet means for admitting a boundary gas into the arc chamber via the axial gaps so as to form a boundary layer of gas about the surface thereof;

first DC constant current source means adapted to be connected to one of the upstream electrode segments and one of the downstream electrode segments for forming an arc therebetween and extending through the interelectrode segments;

second DC constant current source means adapted to be connected to the other upstream electrode segment and the other downstream electrode segment for forming a second arc therebetween and extending through the interelectrode segments, the two arcs combining over a portion of their length and heating a portion of the admitted gas to form a core region of arc-heated gas;

gas exit means adjacent the downstream electrode segments for conducting the arc heated gas from the arc chamber;

upstream gas inlet means positioned upstream of the upstream electrode segments;

downstream gas inlet means positioned downstream of the downstream electrode segments, the upstream and downstream gas inlet means admitting a gas into the upstream and downstream electrode segments, respectively, for axially positioning the arc on the surfaces thereof;

plurality of resistor means, a resistor means electrically interconnected between each interelectrode segment and one of the electrode segments that is connected as the cathode for providing sufficient voltage across the axial gaps to successively initiate arcing in the axial gaps and an establishment of the arc between the electrode segments limiting flow of leakage current from the arc through the each interelectrode segment to a value less than 1 ampere thereby reducing strikeover of the arc to the interelectrode segments, the shape of the arc chamber facilitating transfer of the arcs to the downstream electrode with the boundary layer decreasing convective heat loss of the core region of hot gas to the segments while maintaining the electrical insulation between segments.

24. The apparatus of claim 23 further comprising the upstream electrode segments being electrically connected as the anodes with the downstream electrode segments being electrically connected as the cathodes.

25. The apparatus of claim 24 further comprising:

plurality of coil means for creating a magnetic field about the arc chamber for rotating the arc therein, the coil means positioned about each electrode segment and interelectrode segment; and coil power supply means for electrically energizing the coil means.

26. The apparatus of claim 23 wherein the gas has an inlet pressure in the range of about 1 atmosphere to about 50 atmospheres.

27. The apparatus of claim 26 wherein the gas has an inlet pressure in the range of about 4 atmospheres to about 6 atmospheres.

28. The apparatus of claim 26 wherein the gas is selected from a group consisting of hydrogen, carbon monoxide, carbon dioxide, water vapor, air, nitrogen, oxygen, argon, and combinations thereof.

29. The apparatus of claim 23 wherein the inlet temperature of the gas is about ambient temperature and the temperature of the core of hot gas is in the range of about 1000° C. to about 10,000° C.

30. The apparatus of claim 23 wherein the inside diameters of each of the interelectrode segments are dimensioned such that the ratio of total gas flow to unit area is approximately constant.

31. An electric arc heater, comprising:

an upstream electrode segment;

a downstream electrode segment, the upstream and downstream electrode segments being substantially cylindrical, spaced apart, hollow, and axially aligned;

a plurality of electrically insulated interelectrode segments positioned intermediate the upstream electrode segment and the downstream electrode segment, the interelectrode segments being substantially cylindrical, hollow, axially spaced apart from each other and the electrode segments forming a series of axial gaps therebetween, and forming an arcing chamber therein, the interelectrode segment adjacent the upstream electrode segment having an internal diameter less than the internal diameter thereof and the interelectrode segment adjacent the downstream electrode segment having an internal diameter less than or equal to the internal diameter thereof with the internal diameters of the interelectrode segments increasing in a step-wise manner in the downstream direction;

core gas inlet means for admitting a core gas to be heated in the arc chamber;

boundary gas inlet means for admitting a boundary gas into the arc chamber via the axial gaps so as to form a boundary layer of gas about the surface thereof;

DC power supply means adapted to be connected to the upstream electrode segment and the downstream electrode segment for forming an arc therebetween and extending through the interelectrode segments, the arc heating the core gas and a portion of the admitted boundary gas to form a core region of hot gas;

upstream gas inlet means positioned upstream of the upstream electrode segment;

downstream gas inlet means positioned downstream of the downstream electrode segment, the upstream and downstream gas inlet means admitting the gas into the upstream and downstream electrode segments, respectively, for axially positioning the arc on the surfaces thereof;

plurality of resistor means, a resistor means electrically interconnected between each interelectrode segment and the electrode segment connected as the cathode for providing sufficient voltage across the axial gaps to successively initiate arcing in the axial gaps and on establishment of the arc between the electrode segments limiting flow of leakage current from the arc through the each interelectrode segment to a value less than 1 ampere thereby reducing strikeover of the arc to the interelectrode segments, the shape of the arc chamber facilitating transfer of the arc to the downstream electrode with the boundary layer decreasing convective heat loss of the core region of hot gas to the segments while maintaining the electrical insulation between segments.

32. The apparatus of claim 31 further comprising the upstream electrode segment being electrically connected as the anode with the downstream electrode segment being electrically connected as the cathode.

33. The apparatus of claim 32 wherein a second downstream electrode segment is provided adjacent to the downstream electrode segment and is electrically connected to the DC power supply means as a second cathode allowing the current in the arc to be shared between the two cathodes.

34. The apparatus of claim 33 wherein a second upstream electrode segment is provided adjacent to the upstream electrode segment and is electrically connected to the DC power supply means as a second anode allowing the current in the arc to be shared between the two anodes.

35. The apparatus of claim 31 further comprising:

plurality of coil means for creating a magnetic field about the arc chamber for rotating the arc therein, the coil means positioned about each electrode segment and interelectrode segment; and coil power supply means for electrically energizing the coil means.

36. The apparatus of claim 31 wherein the gas has an inlet pressure in the range of about 1 atmosphere to about 50 atmospheres.

37. The apparatus of claim 36 wherein the gas has an inlet pressure in the range of about 4 atmospheres to about 6 atmospheres.

38. The apparatus of claim 36 wherein the gas is selected from a group consisting of hydrogen, carbon monoxide, carbon dioxide, water vapor, air, nitrogen, oxygen, argon, and combinations thereof.

39. The apparatus of claim 31 wherein the inlet temperature of the gas is about ambient temperature and the temperature of the core of hot gas is in the range of about 1000° C. to about 10,000° C.

40. The apparatus of claim 31 wherein the inside diameters of each of the interelectrode segments are dimensioned such that the ratio of total gas flow to unit area is approximately constant.

* * * * *